United States Patent [19]

Sutter

[11] 4,014,522

[45] Mar. 29, 1977

[54] PERMANENTLY FIXED END RAILS ON TELESCOPIC BLEACHER SEATS

[75] Inventor: David L. Sutter, Kennebunkport, Maine

[73] Assignee: Hussey Manufacturing Company, Inc., North Berwick, Maine

[22] Filed: Nov. 17, 1975

[21] Appl. No.: 632,401

[52] U.S. Cl. ..... 256/59; 52/9; 206/518

[51] Int. Cl.[2] ..... E04H 17/14

[58] Field of Search ..... 256/59; 52/9, 10, 182, 52/183, 184, 6, 8, 188; 211/126; 206/518

[56] References Cited

UNITED STATES PATENTS

| | | | |
|---|---|---|---|
| 616,515 | 12/1898 | Williams | 52/183 |
| 1,690,073 | 10/1928 | Kincaid | 206/518 |
| 2,241,707 | 5/1941 | Langel | 206/518 X |
| 3,788,608 | 1/1974 | Raymond et al. | 52/183 X |

*Primary Examiner*—Wayne L. Shedd
*Attorney, Agent, or Firm*—Robert T. Gammons

[57] ABSTRACT

A bleacher stand of the telescoping kind, wherein a plurality of sections each including a platform and a seat are arranged to be stacked for storage in a vertical column, with the sections situated one above another and to be withdrawn from said stacked position to an extended position wherein the sections are stepped, characterized in that there are guard rails fastened to the ends of the platform portions of the sections which slope upwardly and outwardly therefrom so that when the sections are stacked the guard rails nest one within another.

5 Claims, 4 Drawing Figures

PERMANENTLY FIXED END RAILS ON TELESCOPIC BLEACHER SEATS

BACKGROUND OF INVENTION

Bleacher stands comprised of sections provided with guard rails at the ends to prevent accidental falling off are shown in the U.S. Pat. Nos. to Raymond 3,788,608, Wiese 3,401,918 and Mackintosh 3,869,835. The Wiese structure is provided with end rails having telescoping sections mounted to the upper ends of posts so that as the seat sections are telescoped the rail sections fold upwardly into parallel relation. To provide for such parallel disposition the posts are offset at their lower ends. The Raymond structure shows guard rails pivoted to posts which are fastened at their lower ends to the seat sections. One of the posts is pivoted at its lower end and the other removably mounted so that when the seat sections are telescoped the removable posts may be removed for folding of the rails to upright positions. The Mackintosh structure has telescoping seat sections which are progressively from back to front shorter so that when the sections are telescoped the guard rails nest one within another in parallel relation. The structure of this invention is designed to provide a bleacher stand where the telescoping sections are all of the same length and there are guard rails at the ends of the sections which can be nested one within another without folding, telescoping or dismantling any of the structural parts.

SUMMARY OF INVENTION

As herein illustrated, the invention resides in a telescoping bleacher stand comprising a plurality of sections arranged to be stacked for storage one above another in a vertical column and to be withdrawn from the stacked position to an open or extended position in which the sections are stepped and an end structure at each end of each section fixed to the end so as to stand upwardly therefrom to provide a guard rail at the end, characterized in that the end structures of the respective section are inclined outwardly relative to the ends of the sections to which they are attached so that when the sections are moved into telescoping relation for stacking the end structures at the ends of the sections nest one within another in spaced parallel non-interfering relation and when the sections are withdrawn the end structures are free to move forwardly relatively to each other. Each section comprises a platform and seat and the guard rail structures are fastened to the ends of the platforms and extend upwardly therefrom above the seats.

The invention will now be described in greater detail with reference to the accompanying drawings, wherein.

Figure 1:
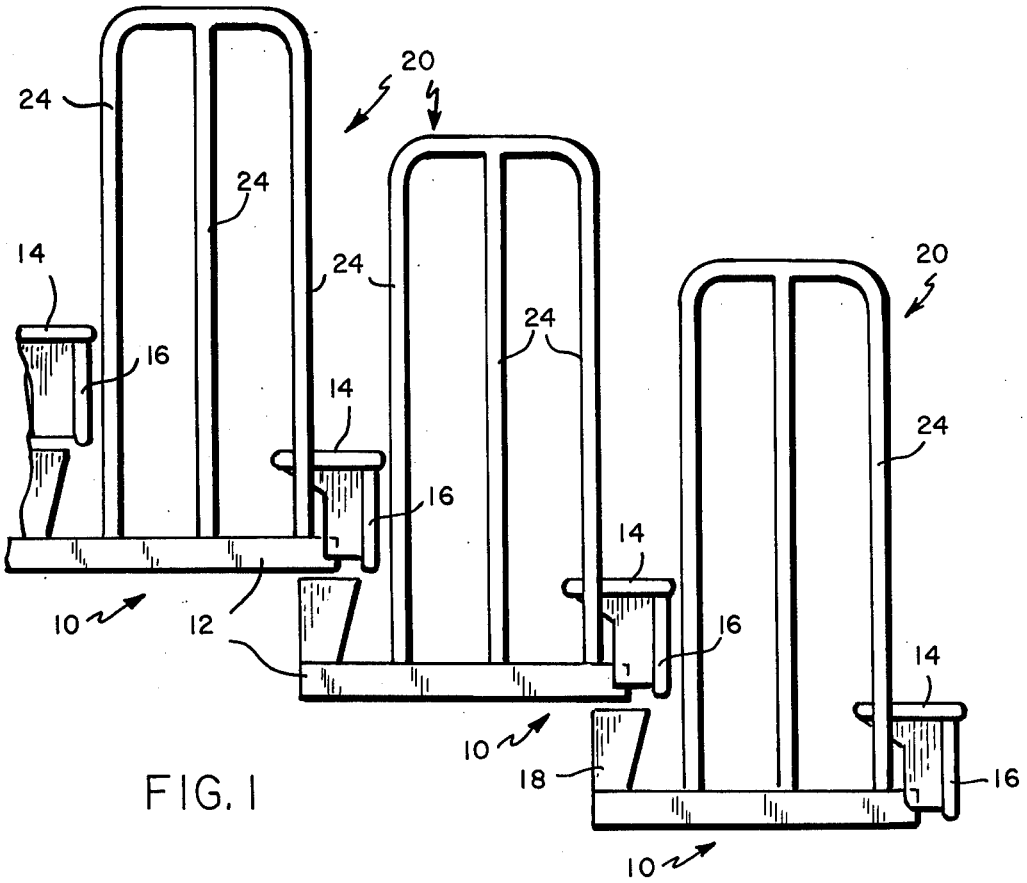
FIG. 1 is a side elevation of a typical folding bleacher with the section extended illustrating guard rails at the ends of successive sections according to this invention.
Figure 2:
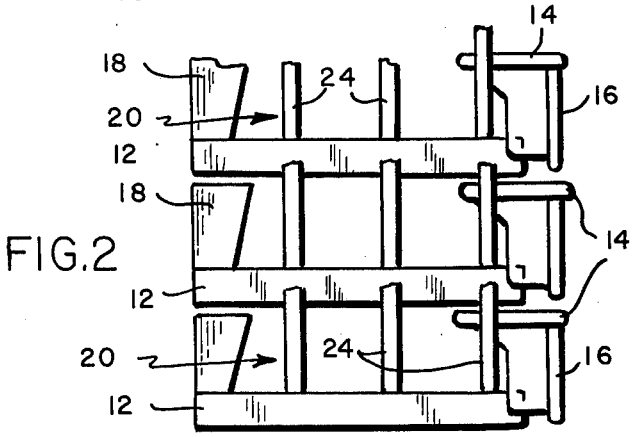
FIG. 2 is a view similar to FIG. 1 illustrating the seating section telescoped.

The bleacher of this invention is of the kind illustrated in the aforesaid Wiese U.S. Pat. No. 3,401,918 wherein a plurality of sections 10, FIGS. 1 and 2, are supported so as to be telescoped for storage one above another in a vertical column against a wall when the stand is not in use and to be extended from this position in which the sections are stepped with relation to each other for use. This is provided for by supporting the sections on columns, the lower ends of which are fixed to carriages provided with rollers by means of which the sections may be rolled along the floor relative to the wall to which the stand is attached for storage and/or for extension. Since the specific supporting structure and carriages by means of which the sections are telescoped for storage and extension is not the subject matter of the invention further description of this aspect of the stand will not be described herein.

Each section 10 comprises a horizontal platform 12, a seat 14 at the front end of the platform and a front riser 16 extending upwardly from the platform to the seat 14. A rear riser 18 at the back end of each section supports the forward end of the sections rearwardly thereof when the sections are extended in conventional manner. In the telescoped or stored position of the sections as shown in FIG. 2 the platforms are situated in a vertical column one above another, as are also the seats and risers.

Figure 3:
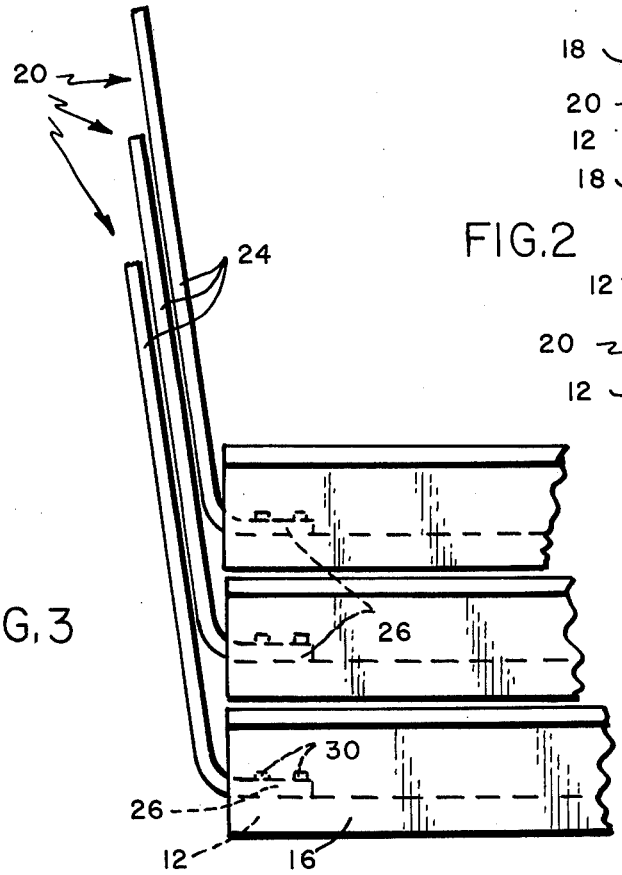
FIG. 3 is a front elevation of the telescoped sections showing the nested arrangement of the guard rails.
Figure 4:
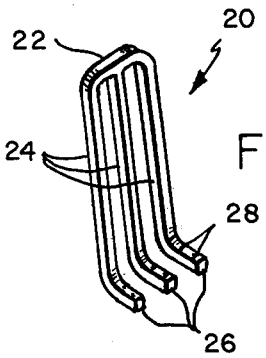
FIG. 4 is a perspective of a guard rail removed from the seating sections.

In accordance with this invention a guard structure 20 is provided at one or both ends of each section to guard against a person accidentally falling over the ends. The guard structure is of a substantially rectangular configuration comprising, as shown in FIG. 4, a top rail 22, two or more spaced parallel posts 24 secured at their upper ends to the rail at a spacing close enough so that a person could not slide through between the posts. In accordance with the invention the posts are provided at their lower ends with feet 26 which are inclined at obtuse angles to the posts 24 as shown in FIG. 3 so that the guard rails when bolted to the horizontal surface of the platform 12 as shown in FIG. 3 extend upwardly and outwardly at an angle to the vertical plane of the ends of the sections. The feet 26 contain spaced holes 28—28 for receiving bolts 30 by means of which they are fastened to the sections. As thus constructed, when the sections are moved to their telescoped storage position, one above another, as shown in FIGS. 2 and 3 the end structures 20 nest one within another in spaced parallel relation in which position they allow movement of the sections to and from their stored positions without interference and without requiring any alteration or repositioning of the end structures therefrom.

Each guard structure 20 is made tall enough so that it extends from the surface of the platform above the seat 14, a sufficient distance to prevent a person from accidentally falling off the end of the seat and preferably to a height such that a person standing on the platform cannot fall over the rail 22.

The arrangement of the guard structure or rails as herein illustrated is of extremely simple design, easy to attach to the respective sections, sturdy enough to withstand the force of a person accidentally falling against it and high enough so that a person cannot fall over it. It has the advantage over prior hand or guard rails that it need not be removed or in any way altered in position for the purpose of storing the sections against the wall, that it is not of complicated construction in that it has no folding or telescoping sections which can bind or become bent so as to interfere with the use of the stand.

It should be understood that the present disclosure is for the purpose of illustration only and includes all modifications or improvements which fall within the scope of the appended claims.

I claim:

1. A telescoping bleacher stand comprising a plurality of sections arranged to be stacked for storage in a vertical column, one above another, and for movement therefrom to an open position in which they are extended from one another in stepped relation, and a free-standing guard rail fixed to each end of each section so that it stands upwardly therefrom and inclines outwardly relative to the end of the section to which it is fixed so that when the sections are moved from their extended positions to their stored positions, the guard rails at the ends of the stacked sections will nest one within another in spaced, parallel, noninterfering relation.

2. A telescoping bleacher stand according to claim 1 wherein each guard rail comprises a rigid frame having at its lower end integral anchoring means disposed at an obtuse angle to the plane of the guard rail.

3. A telescoping bleacher stand according to claim 2 wherein each section comprises a platform and seats and the anchoring means are designed to be attached to the platform.

4. A telescoping bleacher stand according to claim 1 wherein each section comprises a platform, seat and risers therebetween and the guard rails are substantially the width of the platforms and rise to a plane above the seats of the sections to which they are attached.

5. A telescoping bleacher stand according to claim 4 wherein each guard rail comprises a top rail, spaced parallel posts attached at their upper ends to the top rail, and feet at the lower ends of the post which are inclined thereto at obtuse angles.

* * * * *